US007370503B2

(12) United States Patent
Keller

(10) Patent No.: US 7,370,503 B2
(45) Date of Patent: May 13, 2008

(54) SAFETY KEY AND LOCKING CYLINDER, AND LOCKING SYSTEM WITH SUCH SAFETY KEYS AND LOCKING CYLINDERS

(75) Inventor: Ernest Keller, Untere Schwandenstrasse 22, Richterswil (CH) 8805

(73) Assignee: Ernest Keller, Richterswil (CH)

( * ) Notice: Subject to any disclaimer, the term of this patent is extended or adjusted under 35 U.S.C. 154(b) by 0 days.

(21) Appl. No.: 11/297,373

(22) Filed: Dec. 9, 2005

(65) Prior Publication Data

US 2006/0086164 A1 Apr. 27, 2006

Related U.S. Application Data

(62) Division of application No. 10/435,685, filed on May 12, 2003, now Pat. No. 6,973,814.

(30) Foreign Application Priority Data

Jul. 24, 2002 (CH) ..... 1303/02

(51) Int. Cl.
*E05B 27/00* (2006.01)

(52) U.S. Cl. ..... 70/493; 70/408; 70/395; 70/491; 70/337

(58) Field of Classification Search ..... 70/337–340, 70/395, 401, 405–409, 411, 453, 397–399, 70/454
See application file for complete search history.

(56) References Cited

U.S. PATENT DOCUMENTS

| | | | |
|---|---|---|---|
| 851,008 | A | 4/1907 | Jacobson et al. |
| 1,130,337 | A | 3/1915 | Robb |
| 1,163,470 | A | 12/1915 | Schoell |
| 1,222,545 | A | 4/1917 | Gross |
| 1,292,104 | A | 1/1919 | Sheidler |
| 1,832,498 | A | 11/1931 | Mussio |
| 1,843,335 | A | 2/1932 | Oberfield |
| 1,949,406 | A | 3/1934 | Beach et al. |
| 1,979,798 | A | 11/1934 | Glidden |
| 2,030,837 | A | 2/1936 | Full et al. |
| 2,065,294 | A | 12/1936 | Reuben |
| 2,083,859 | A | 6/1937 | North |
| 2,157,142 | A | 5/1939 | Olson |
| 2,388,227 | A | 10/1945 | Heyer |
| 3,780,549 | A | 12/1973 | Schlage |
| 3,834,198 | A | 9/1974 | Wiczer |
| 3,882,702 | A | 5/1975 | Wiczer |
| 3,889,501 | A | 6/1975 | Fort |
| 4,490,998 | A | 1/1985 | Wellekens |

(Continued)

FOREIGN PATENT DOCUMENTS

| | | |
|---|---|---|
| DE | 199 01 054 | 1/1998 |

(Continued)

*Primary Examiner*—Suzanne Dino Barrett
(74) *Attorney, Agent, or Firm*—Browdy and Neimark, PLLC

(57) ABSTRACT

The safety key has a shank which is provided with a plurality of control surfaces for properly positioning tumblers and has a front end and a rear end. At a front end, the rotor of the associated locking cylinder has at least one further control surface, which interacts with a further control surface arranged at the rear end of the shank. The safety key is backward compatible and is relatively difficult to copy.

17 Claims, 5 Drawing Sheets

U.S. PATENT DOCUMENTS

| | | | |
|---|---|---|---|
| 4,553,452 | A | 11/1985 | Keller |
| 4,823,575 | A | 4/1989 | Florian et al. |
| 4,901,547 | A | 2/1990 | Dal Palu |
| 5,513,509 | A | 5/1996 | Bergen |
| 6,058,750 | A | 5/2000 | Li |
| 6,109,081 | A | 8/2000 | Dimig et al. |
| 6,119,495 | A | 9/2000 | Loreti |
| 6,584,819 | B1 | 7/2003 | Hung |
| 6,609,402 | B2 | 8/2003 | Blankenship et al. |
| 6,681,609 | B1 | 1/2004 | Preddy |
| 6,973,814 | B2 * | 12/2005 | Keller ..... 70/493 |
| 2004/0000178 | A1 | 1/2004 | Tseng |

FOREIGN PATENT DOCUMENTS

| | | |
|---|---|---|
| EP | 0 128 475 | 6/1984 |
| EP | 0 816 598 | 1/1998 |
| EP | 0 802 289 | 6/1999 |
| EP | 0 621 384 | 9/1999 |
| GB | 2 356 016 | 8/1999 |

* cited by examiner

Fig. 8a
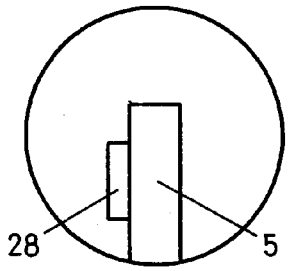
Fig. 8b
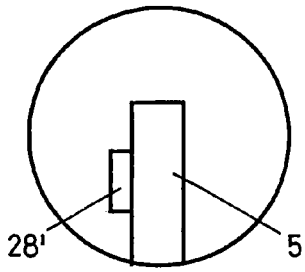
Fig. 8c
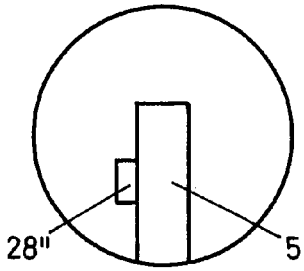
Fig. 8d
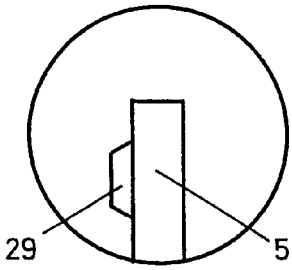
Fig. 8e
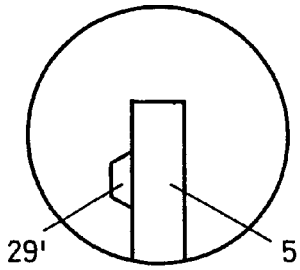
Fig. 8f
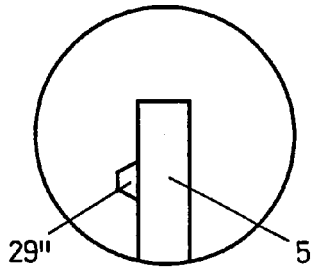
Fig. 9a
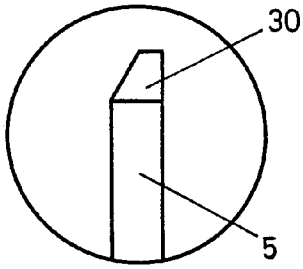
Fig. 9b
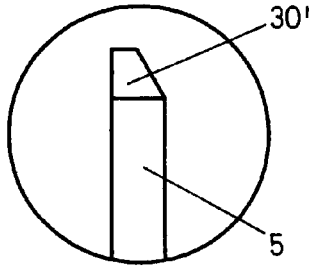
Fig. 9c
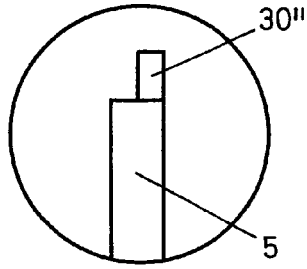
Fig. 9d
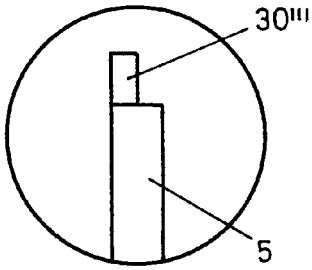
Fig. 9e
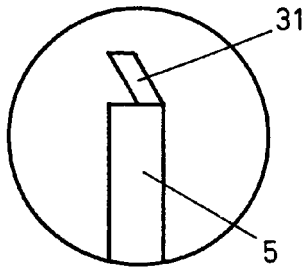
Fig. 9f
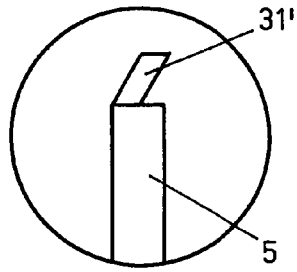
Fig. 9g
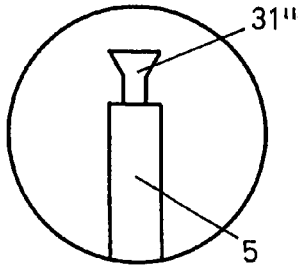
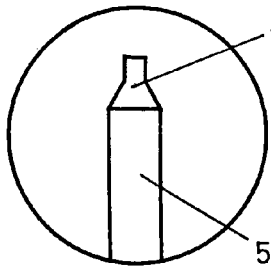
Fig. 9h

SAFETY KEY AND LOCKING CYLINDER, AND LOCKING SYSTEM WITH SUCH SAFETY KEYS AND LOCKING CYLINDERS

This is a division of parent application Ser. No. 10/435,685, filed May 12, 2003, now U.S. Pat. No. 6,973,814.

BACKGROUND OF THE INVENTION

1. Technical Field of Use of the Invention

The invention relates to a safety key and locking cylinder, the locking cylinder having a stator and a rotor, with a front end and a rear end, and a keyway, and the safety key having a shank which is provided with a plurality of control surfaces for properly positioning tumblers and has a front end and a rear end. The invention also relates to a locking system with such safety keys and locking cylinders.

2. Prior Art

Safety keys and locking cylinders of the above-mentioned type are known in numerous configurations. The essential factor for safety keys for high-grade systems is for there to be no possibility of straightforward copying on comparatively simple drilling and milling machines. A safety key which is difficult to copy may be achieved in accordance with the applicant's EP 0 621 384 B1 by the shank of the safety key being provided with a control element which is designed as a pin and is mounted in a displaceable manner in the shank. This control element can be properly positioned by an additional tumbler in the locking cylinder. Such a key cannot be copied with justifiable outlay. A so-called toothed key with a similar control element has been disclosed in EP 0 802 289. It is also ensured that this key is comparatively difficult to copy.

The abovementioned safety key is rendered disadvantageous by the costs which arise from the formation of the abovementioned control elements and from the additional tumblers in the locking cylinder. These control elements, in addition, may have an adverse effect on the combinatorics.

OBJECT AND SUMMARY OF THE INVENTION

The object of the invention is to provide a safety key which is difficult to copy and, nevertheless, can be produced comparatively cost-effectively.

The object is achieved, in the case of a safety key of the generic type, in that, at its front end, the rotor is extended and has at least one further control surface, which interacts with a further control surface arranged at the rear end of the shank. In the case of the key according to the invention, the front extended end of the rotor and the rear end of the key shank are used for providing further control surfaces. These control surfaces may be produced particularly cost-effectively by depressions and in particular by slots in the extended front end of the rotor. On the safety key, the control surfaces may be created particularly cost-effectively by recesses and in particular milled cut-out on shoulders of the key shank. The safety key may be a turning key with bores in the key shank or also some other safety key, for example a toothed key or cam key.

A significant advantage of the safety key according to the invention is that it is backward compatible. The safety key and the locking cylinder according to the invention can readily be integrated in an existing system. In the case of a system which is supplemented in this way, it is possible to have a general key which operates both the existing locking cylinders and the locking cylinders according to the invention. The existing safety keys, however, cannot open the corresponding new locking cylinders. It is thus possible for any existing locking system to be extended and enhanced. The additional control surface of the rear end of the shank results in comparatively high outlay being required for copying purposes, since additional and usually unavailable tools and special blanks are necessary.

A further advantage of the invention is also to be seen in the fact that the system design is simplified. In addition, the flexibility of such systems is increased and it is easily possible to form groups which do not effect the permutation. The invention benefits the combinatorics to a considerable extent and simplifies the subdivision of groups.

A particularly high level of security is achieved when, at the rear end of the shank, the safety key has at least one laterally projecting part which interacts with a control surface at the front end of the rotor. Such a projecting part is, for example, a lug which is difficult to copy but can be produced without significant further costs. The lug may be produced in different shapes and dimensions in a locking system in order to increase the number of locking arrangements.

Further advantageous features can be gathered from the following description and the drawing.

BRIEF DESCRIPTION OF THE DRAWINGS

Exemplary embodiments of the invention are explained in more detail hereinbelow with reference to the drawing, in which:

FIGS. 8*a* to 8*f* show, schematically, front views of locking cylinders according to a further variant, FIGS. 9*a* to 9*h* show, schematically, front views of locking cylinders according to a further variant.

DETAILED DESCRIPTION OF THE PREFERRED EMBODIMENTS OF THE INVENTION

Figure 1A:
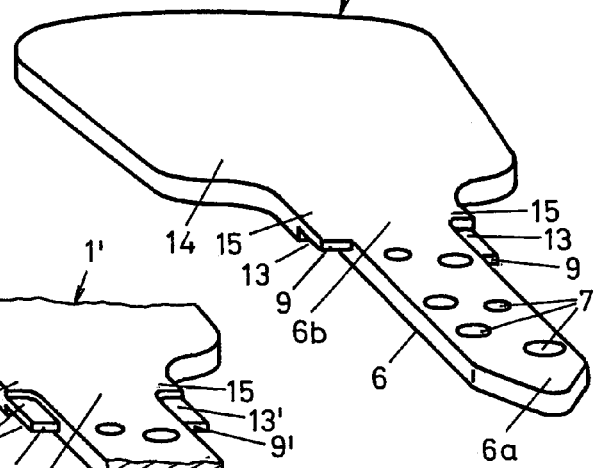
FIGS. 1*a* to 1*c* show, schematically, three-dimensional illustrations of safety keys according to the invention.

FIG. 1*a* shows a safety key 1 which has a shank 6 and a grip 14. The key 1 is a so-called flat key or turning key. It is also possible, however, for the key to be a toothed key or cam key. The shank 6, in a manner known per se, has control bores 7, which are usually made in the broad sides and in the narrow sides of the shank 6. These control bores 7 serve for properly positioning tumblers (not shown here) which are known per se and belong to an associated locking cylinder 2, which, according to FIG. 3*a*, has a stator 3 and a rotor 4.

The shank 6 of the key 1 has a front-end 6*a* and a rear end 6*b*. By means of the front-end 6*a*, the key 1 is introduced in the customary manner into a keyway 5 of the rotor 4. The abovementioned tumblers are properly positioned by virtue of the shank 6 being introduced into the keyway 5. As a result, the rotor 4 is unlocked and can be rotated by way of the grip 14 of the key for the purpose of actuating the lock.

Figure 2A:
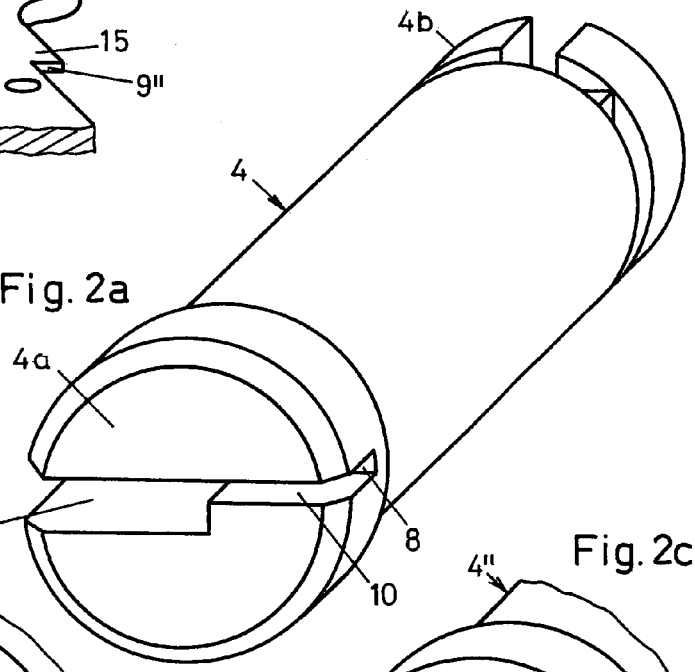
FIGS. 2*a* to 2*c* show, schematically, three-dimensional views of rotors of locking cylinders according to the invention.
Figure 2B:
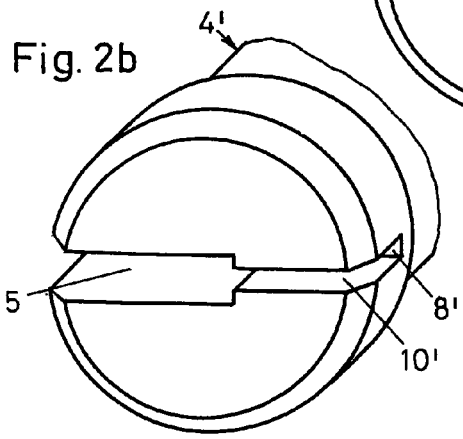
Figure 2C:
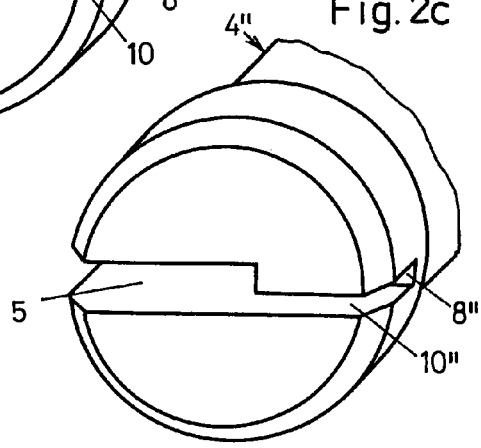

At its rear end 6*b*, the key 1 has additional control surfaces 9, which are formed by laterally projecting shoulders 15 and recesses 13 in these shoulders 15. These control surfaces 9 interact with a corresponding control surface 8 of the rotor 4, which is depicted in FIG. 2. The control surface 8 is formed by a recess 10 which is made in an extended front end 4*a* of the rotor 4. The control bores 7 are positioned such that the corresponding tumblers are at locking level if the control surfaces 9 butt against the control surface 8. The recess 10 maybe be produced, for example, by a milling cutter. The recess 10 is offset laterally in relation to the keyway 5, as can be seen in FIG. 2*a*. Correspondingly, the control surfaces 9 of the key la are likewise offset laterally. In the case of a turning key, the control surfaces 9 are rotationally symmetrical in relation to one another. If the shank 6 is inserted into the keyway 5, then one shoulder or the other engages into the slot 10 until a control surface 9 butts against the control surface 8. The control surface 8 here forms a stop for the safety key 1.

Figure 1B:
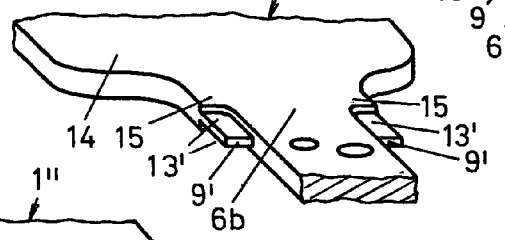

The key 1' according to FIG. 1*b* has control surfaces 9' which are formed in each case by two lateral recesses 13". The control surfaces 9' are arranged centrally in relation to the plane of the key 1. The associated rotor 4' is shown in FIG. 2*b*. The recess 10', as can be seen, is arranged in the center of the keyway 5 and forms a control surface 8'. The recess 10' here is a slot which is open laterally and at the front.

Figure 1C:
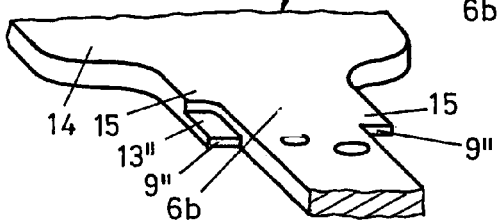

Control surfaces 9" of the key 1" according to FIG. 1*c* are formed by recesses 13". The corresponding rotor 4" is shown in F*ig.* 2*c*. The recess 10', is likewise offset laterally, but in the opposite direction to FIG. 2*a*. The control surface 8" is formed by the slot 10". The slots 10, 10' and 10" and the corresponding recesses 13, 13' and 13" may also be designed differently. Intermediate stages are also possible. In addition, the slots 10, 10' and 10" need not necessarily be continuous and linear.

Figure 3A:
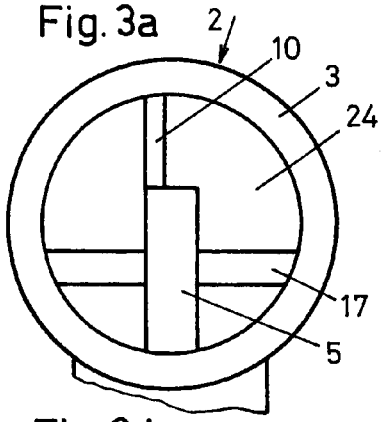
FIGS. 3*a* to 3*f* show, schematically, front views of locking cylinders according to the invention, the stator having been left out in FIGS. 3*b* to 3*f*, FIGS. 4*a* to 4*d* show schematic views of safety keys according to a variant.
Figure 3B:
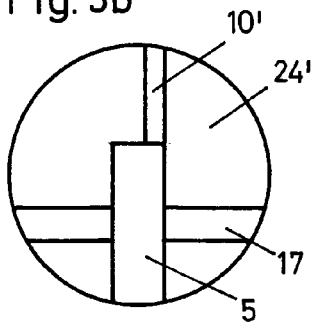
Figure 3C:
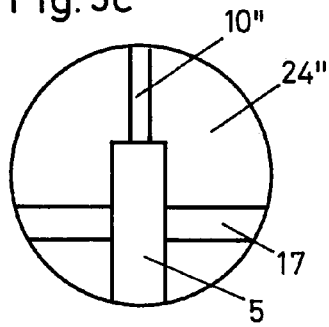
Figure 3D:
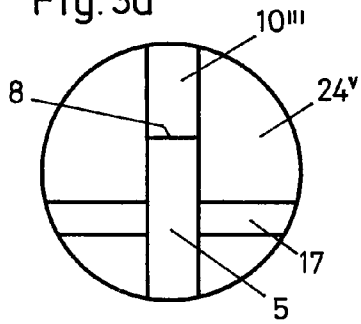
Figure 4A:
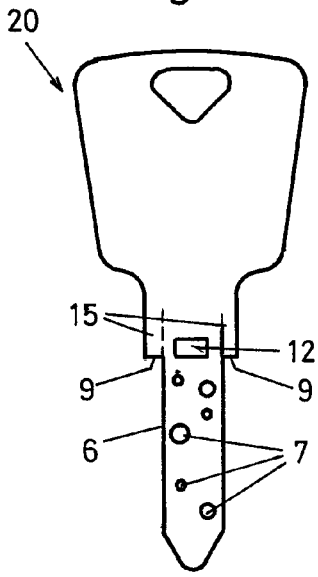
Figure 4B:
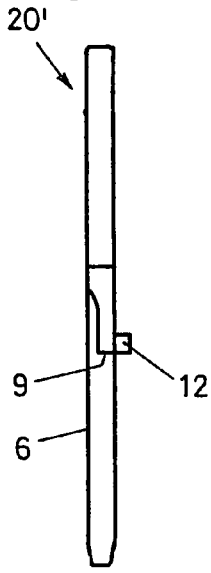
Figure 4C:
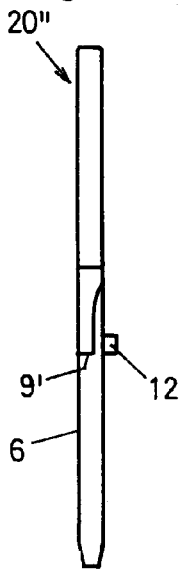
Figure 4D:
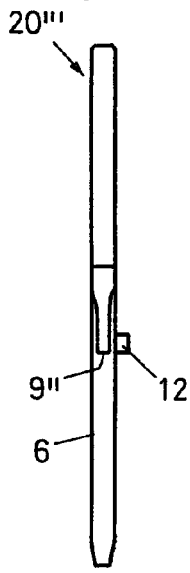

FIG. 4*a* shows a key 20 with a projecting lug 12 arranged laterally on a shoulder 15 of the shank 6. The keys 20', 20" and 20, according to FIGS. 4*b* to 4*d* are provided with the abovementioned respective control surfaces 9, 9" and 9', with the abovementioned functions. The lug 12 forms a further group-forming means. The corresponding locking cylinders 2 are shown in FIGS. 3*a* to 3*c*. The locking cylinder 2 according to FIG. 3*a* has a rotor 24 which is mounted in a housing 3. A slot 17 is made in the extended front end of the rotor 24, the slot running at right angles to the keyway 5, as FIG. 3*a* shows. This slot 17 is formed such that it can accommodate the lug 12. The key according to FIG. 4*c* is provided for the rotor 24' according to FIG. 3*b*. The recess 10, here is offset to the right in relation to the keyway 5. The slot 17 corresponds to that according to FIG. 3*a* and, in this case, likewise serves for accommodating the lug 12. The key according to FIG. 4*d* is provided for the rotor 24" according to FIG. 3*c*. The key 20", shown in FIG. 4*d* cannot operate the rotors 24 and 24' since the control surface 9' is central and not offset laterally. The key 20" according to FIG. 4*c*, in turn, can only operate the rotor 24' according to FIG. 3*b*. The same applies to the key 20'. All three safety keys described, however, also open cylinders with rotors according to FIG. 3*d*.

Figure 5A:
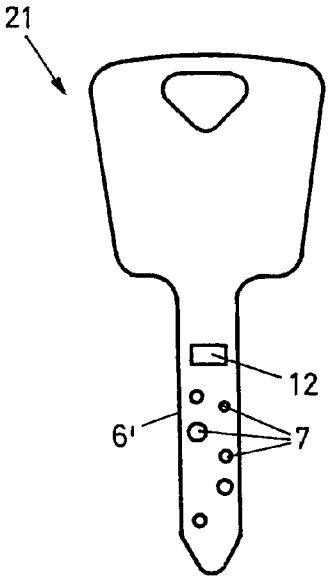
FIGS. 5*a* and 5*b* show, schematically, further views of a safety key according to the invention.
Figure 5B:
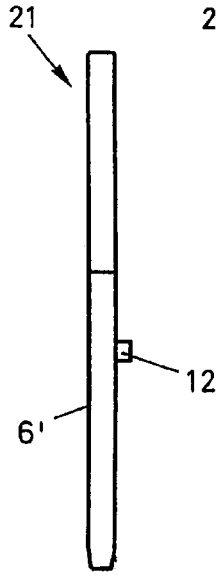

FIGS. 5*a* and 5*b* show a key 21 which has a lateral lug 12 but no shoulder 15. The shank 6' of the key 21 nevertheless corresponds to the length of the shank 6. The key 21 can operate all the rotors 24, 24' and 24" since, in this case, the slots 10, 10' and 10" do not have any excluding function. The key 21 is thus a passe-partout for the lock cylinders 2 according to FIGS. 3*a* to 3*e*.

FIG. 3*d* shows a central rotary locking cylinder 24' which can be operated by all the keys 20 to 20'" and by the passe-partout 21 and by a master key 22. This is ensured by the wide slot 10'", which is the same width as the keyway 5. The control surface 18 on the base of the slot 10'" is of a corresponding width.

Figure 3E:
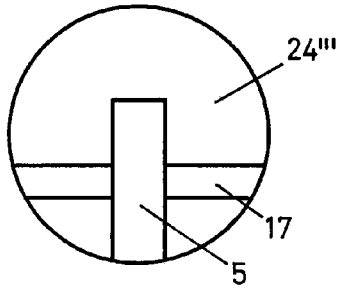

FIG. 3*e* shows a blocking cylinder 24'" which can be operated by the key 21 but not by the keys according to FIGS. 4*a* to 4*d*. The rotor extends in solid form over the keyway 5 and, correspondingly, the shoulders 15 prevent the control surfaces 7 from being positioned in a manner which is necessary for releasing the rotor. The rotary locking cylinder 24'" can nevertheless be operated by the key 21 and key 22, since these have no shoulders 15.

Figure 3F:
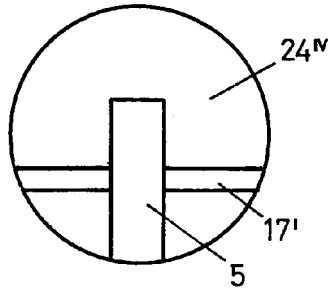
Figure 6:
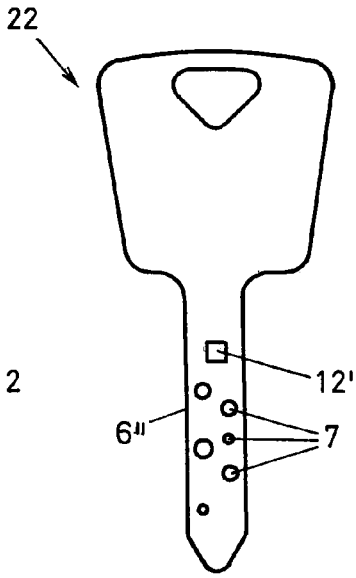
FIG. 6 shows, schematically, a view of a master key.

FIG. 6 shows the master key 22, which has a shank 6', with a laterally arranged narrow lug 12'. This key 22 has no shoulders 15. This master key 22 operates all the rotors of FIGS. 3*a* to 3*e* and the rotor 24'$^{v}$ of FIG. 3*f*. This rotor 24'$^{v}$ has a slot 17' which is considerably narrower than the recess 17 and has a width of, for example, 1.5 mm.

Figure 7A:
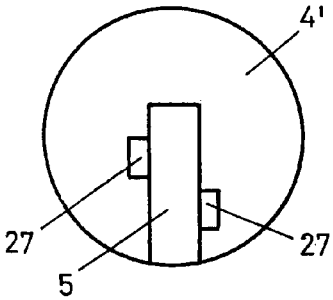
FIGS. 7*a* to 7*f* show, schematically, front views of locking cylinders according to a variant.
Figure 7B:
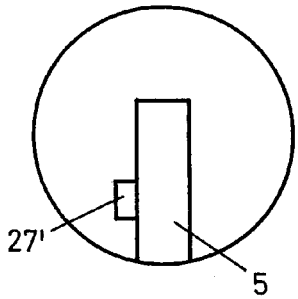
Figure 7C:
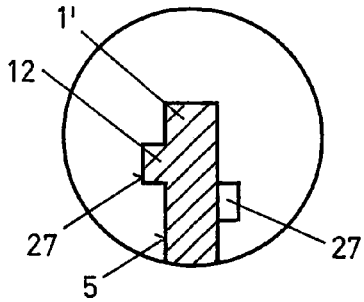
Figure 7D:
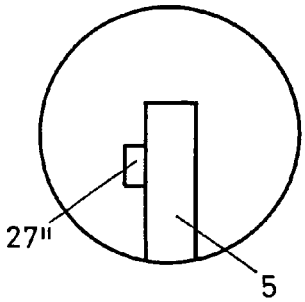
Figure 7E:
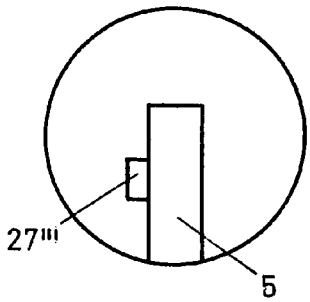
Figure 7F:
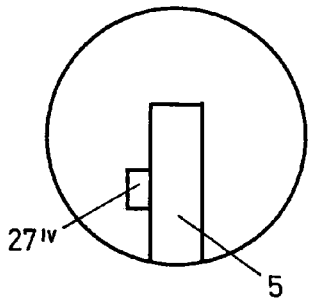

FIGS. 7*a* to 7*f*, 8*a* to 8*f* and 9*a* to 9*h* illustrate the large number of locking arrangements which can be formed by different recesses 27', 27", 27'", 27'v; 28, 28', 28"; 29, 29', 29"; 30, 30', 30", 30'" and 31, 31', 31", 31'" in the front end of the rotor 4 or 4'. The associated safety keys 1 and 1' have corresponding control surfaces 9 and 12, which interact with the control surfaces of these recesses. FIG. 7*c* also shows, in section, a shank of a key 1'. As can be seen, the lug 12 engages in the recess 27 here. A turning key has two recesses 27 in each case, as is shown in FIGS. 7*a* and 7*c*.

As can be seen, the invention allows the construction of locking systems with group and individual locking arrangements. Existing systems may be supplemented with corresponding rotors and keys. The production of extended-head rotors and keys with the abovementioned control surfaces and lugs 12 can be carried out comparatively cost-effectively. The slots and/or recesses in the extended head of the rotor can be varied in many different ways. Numerous variations of the control surfaces 9 and shoulders 15 and of the lug 12 are likewise possible.

Figure 10:
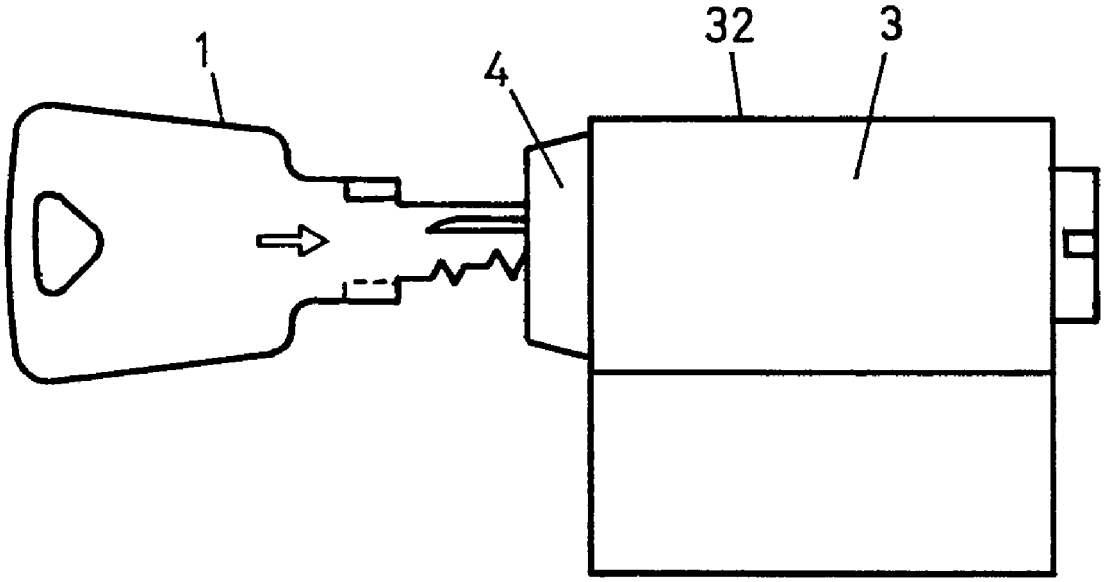
FIG. 10 shows, schematically, a side view of a locking cylinder and a key partly introduced into the keyway.
Figure 11:
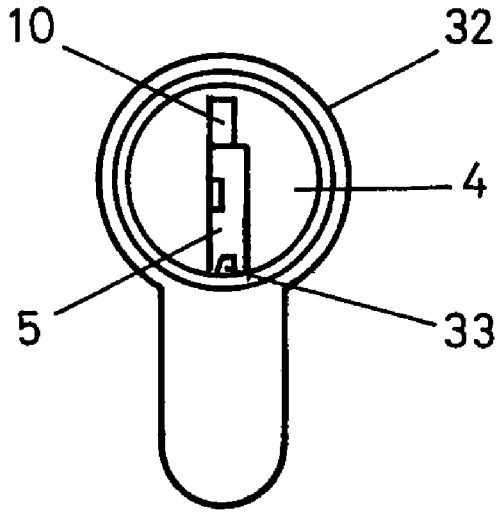
FIG. 11 shows a front view of the locking cylinder, whereas the key is not shown.

FIGS. 10 and 11 show a locking cylinder 32, provided with a stator 3 and a rotor 4. As can be seen, the front-end 4*a* of the rotor 4 protrudes from the stator 3, but this is not mandatory. The front-end 4*a* could be flushed with the front end of the stator 3. The key 1 is a Yale type key for properly positioning tumblers 33.

What is claimed is:

1. A locking system comprising:

a plurality of safety keys and locking cylinders;

each of the locking cylinders having a stator and a rotor having at least one rotor control surface, a front end, a rear end, and a keyway having parallel sides, wherein a width of the rotor control surface is less than that of the keyway;

and each of the safety keys having a shank which is provided with a plurality of first shank control surfaces on the upper surface of the shank which position tumblers in a body of the rotor and a front end and a rear end;

wherein the at least one rotor control surface is located on the front end of the rotor and engages with a second shank control surface which is recessed below the upper and/or the lower surface of the shank and arranged at the rear end of the shank;

wherein a lug projecting transverse to the plane of the shank is fixed on the rear end of the shank and engages a corresponding first recess on front of the rotor, the first recess having sides perpendicular to the sides of the keyway, wherein the lugs of the plurality of safety keys have different shapes or dimensions in order to increase the number of locking arrangements, and wherein the rotor control surfaces of the rotors are formed by second recesses of different extents or in different positions corresponding to different shapes or dimensions of the second shank control surface arranged at the rear end of the shank.

2. The key as claimed in claim 1, wherein the front end of the rotor projects beyond the front of the stator and the first recess of the rotor engaging the lug is made in the front end of the rotor projecting beyond the front of the stator.

3. The key as claimed in claim 2, wherein the at least one rotor control surface of the rotor is formed by a second recess in the front end of the rotor.

4. The key as claimed in claim 1, wherein the at least one rotor control surface of the rotor is formed by a second recess located in the rotor and is open at the front.

5. The locking system as claimed in claim 4, wherein the second recess is open in the direction of the keyway.

6. The locking system as claimed in claim 5, wherein the second recess passes centrally or in a laterally offset manner through the keyway.

7. The locking system as claimed in claim 4, wherein the second recess extends radially in relation to the axis of the rotor and is open at the front and also to the side of the rotor.

8. The locking system as claimed in claim 3, wherein the second recess of the rotor has a depth of not more than 0.5 to 3 mm.

9. The locking system as claimed in claim 8, wherein the second recess has a depth of approximately 1 to 2 mm.

10. The locking system as claimed in claim 1, wherein the second shank control surface of the key arranged at the rear end of the shank is formed by at least one shoulder.

11. The locking system as claimed in claim 4, wherein the second shank control surface of the key arranged at the rear end of the shank is formed by at least one third recess on at least one shoulder of the key.

12. The locking system as claimed in claim 11, wherein at least two shoulders each have the third recess.

13. The locking system as claimed in claim 12, wherein a turning key and the shank thereof have a plurality of control bores for properly positioning tumblers.

14. The locking system as claimed in claim 2, wherein the second recess in the front end of the rotor is closed in the direction of the outside of the rotor.

15. A safety key for the locking system according to claim 1, having the shank which is provided with the plurality of first control surfaces for properly positioning tumblers and has the front end and the rear end, wherein second control surfaces are located at the rear end of the shank, wherein a lug projecting transverse to the plane of the shank is fixed on the shank and can be inserted into a corresponding recess of the rotor, and wherein the second control surface of the key is formed by at least one shoulder at the rear end of the shank.

16. Safety key according to claim 15, wherein the shoulder has at least one recess.

17. Safety key according to claim 15, wherein arranged laterally on the shank of the key is a laterally projecting part forming the lug.

* * * * *